US005572738A

United States Patent [19]

Melone, Jr.

[11] Patent Number: 5,572,738

[45] Date of Patent: Nov. 12, 1996

[54] HAND PROTECTOR

[76] Inventor: Charles P. Melone, Jr., 62 W. 12th St., New York, N.Y. 10011

[21] Appl. No.: 484,543

[22] Filed: Jun. 7, 1995

Related U.S. Application Data

[63] Continuation of Ser. No. 221,770, Apr. 1, 1994, abandoned.

[51] Int. Cl.[6] ..... A41D 13/10

[52] U.S. Cl. ..... 2/16; 2/18

[58] Field of Search ..... 2/16, 18, 20, 161.1, 2/167, 168

[56] References Cited

U.S. PATENT DOCUMENTS

| | | | |
|---|---|---|---|
| 563,585 | 7/1896 | Frazier | 2/18 |
| 1,706,503 | 10/1927 | Travers . | |
| 3,164,841 | 1/1965 | Burtoff | 2/21 |
| 3,568,212 | 3/1971 | Seaborn | 2/18 |
| 3,581,312 | 6/1971 | Nickels | 2/20 X |
| 3,994,025 | 11/1976 | Petroski . | |
| 4,176,407 | 12/1979 | Goebel et al. | 2/20 |
| 4,287,609 | 9/1981 | Amadeo . | |
| 4,290,147 | 9/1981 | Brückner . | |
| 4,295,229 | 10/1981 | Clark et al. . | |
| 4,441,213 | 4/1984 | Trumble et al. | 2/16 |
| 4,478,408 | 10/1984 | Brückner . | |
| 4,658,441 | 4/1987 | Smith . | |
| 5,402,536 | 4/1995 | Matthews | 2/16 |

FOREIGN PATENT DOCUMENTS

| | | |
|---|---|---|
| 2612307 | 3/1976 | Germany . |
| 2237725 | 10/1990 | United Kingdom . |
| 2281499 | 3/1995 | United Kingdom . |

*Primary Examiner*—Paul C. Lewis
*Attorney, Agent, or Firm*—Felfe & Lynch

[57] ABSTRACT

An apparatus for protecting the hand from injuries resulting from contact with an object. An outer member and an inner member cooperate to protect the anatomical configurations of the hand by acting as a joint stabilizer to reduce excessive and deleterious joint motion and by acting as a shock absorber to diffuse axial compression, tension, rotational, and other detrimental forces transmitted to the unprotected anatomical configurations of the hand.

6 Claims, 7 Drawing Sheets

HAND PROTECTOR

This application is a continuation of application Ser. No. 08/221,770, filed Apr. 1, 1994, now abandoned.

FIELD OF INVENTION

The present invention is an apparatus for protecting a hand from injuries resulting from impact with an object. More specifically, it is an apparatus that acts as both a shock absorber and a joint stabilizer to protect the hand when it strikes an object by stabilizing the joints and by diffusing the axial compression, tension, rotational, and other detrimental forces before they can be transmitted to the anatomical configurations of the hand. In a preferred embodiment, it is designed to cushion and stabilize the dorsal and volar surfaces of the metacarpophalangeal joints (MPJ), commonly referred to as the "knuckles," the carpometacarpal joints (CMCJ), the fingers, and the wrist, thereby reducing the likelihood of injury to these highly sensitive sites.

BACKGROUND OF THE INVENTION

Direct or indirect impact of a hand, often in the clenched fist position, with an object, regardless of the hardness or density of the object, can result in injury because of the detrimental forces acting on the anatomical configurations of the hand. Such impact frequently produces forces sufficient to cause injuries to one or more metacarpophalangeal joints (MPJ) (commonly termed the "knuckles") or carpometacarpal joints (CMCJ) of any finger of the hand, or the thumb, or the carpal bones or the distal radio ulnar joint (DRUJ).

When repeated impact of the hand with an object occurs, for example, in contact sports such as boxing or in performing occupational duties such as law enforcement or military service, injuries of the hand are more likely to occur and can severely hamper or totally prevent use of the hand. The adverse effect of hand injuries on performance is nowhere more profound than in boxing because the recurrent high energy forces generated by the hand's clenched-fist striking a target, coupled with its vulnerable anatomical configurations, predisposes it to predictable and disabling injuries. The flawless punching mechanics, unparalleled hand speed, coordination, and strength of the skillful boxer are thus prone to compromise. Furthermore, the hands are the boxer's principal means of defense because they are used to counterpunch and to block incoming blows. Thus, when hand injury occurs, both offensive and defensive capacities diminish and the boxer becomes vulnerable to further injury.

A boxer's hands are the tools of his trade. However, like all tools, boxers' hands are prone to mechanical failure. Indeed, corroborating a long-standing impression among sports medicine experts, evidence is accumulating that hand injuries in boxing may constitute a sport-specific epidemic.

The most serious hand injury encountered among boxers, which can result from direct blows to the knuckles of a clenched-fist, is metacarpophalangeal joint damage, including extensor mechanism disruption, either partial or complete, termed the "Boxer's Knuckle," due to its prevalence in boxing. Other common injuries of the metacarpophalangeal joints are digital fractures, capsular tears, collateral ligament disruptions, and articular fractures. These injuries often occur at the long finger knuckle due to its vulnerable protrusion as well as an anatomical predisposition, however, these injuries also occur at the other knuckles with considerable frequency.

The relaxed or gently clenched fist within a boxing glove, unexposed to compressire forces, demonstrates mild to moderate flexion of the metacarpophalangeal joints. In contrast, the impact caused by a forceful punch causes the clenched-fist to considerably alter its contours. The metacarpophalangeal joints are forced into acute flexion, almost to a degree of subluxation, and overlying extensor mechanisms along with adjacent joint capsules and collateral ligaments are stretched to maximum tension across the dorsally prominent metacarpal heads. The metacarpophalangeal joints, especially those of the protrusive, more vulnerable index and long fingers, are protected only by a thin envelope of skin and subcutaneous tissues, and thus are prone to serious damage when subjected to the excessive forces generated by boxing.

The extensor mechanism includes a stout central tendon and less substantive transverse, peripheral fibers, termed sagittal bands, stabilizing the central tendon and spanning the radial and ulnar margins of the joint. The intact extensor mechanism permits unimpaired metacarpophalangeal joint motion and by virtue of its broad fibrous configuration provides a protective cover for the underlying articular structures. Conversely, extensor mechanism disruption compromises metacarpophalangeal joint function and also increases the risk of additional injury to unsheathed subjacent articular components.

Extensor mechanism injury of the metacarpophalangeal joint (MPJ) reveals a characteristic spectrum of pathology. Most commonly the sagittal band, either radial or ulnar, demonstrates a tear adjacent to the central tendon; less frequently, the central tendon splits longitudinally. The most extensive lesion, apt to result from a force causing both extreme flexion and ulnar deviation of the knuckle, is a complete rupture of the radial sagittal band with ulnar dislocation of the central tendon. Profound joint swelling, compromised metacarpophalangeal joint extension, often with an extensor lag, and central tendon dislocation or subluxation with a palpable and exquisitely tender tissue defect at the site of rupture, are characteristic features of the complete rupture. This major disruption invariably occurs in association with a massive capsular tear and requires prompt repair for restitution of soft tissue integrity and preservation of joint function.

Variation in the basic closed fist mechanism of injury accounts for the proclivity of injury at other specific anatomical sites. Either a violent blow just proximal to the knuckle or an axial force transmitted proximally along the metacarpal shaft is liable to disrupt and destabilize the carpometacarpal joints, usually those of the vulnerable index and long fingers. The carpometacarpal joints of these digits are characterized by precision-fit bony contours and strong capsular ligaments serving to bind tightly the metacarpal shafts to the wrist. While this rigid configuration creates a sturdy central column affording skeletal stability and strength necessary for normal hand function, the inflexible, unyielding structure of the index and long carpometacarpal joints renders them highly susceptible to injury from recurrent high-energy forces generated by continuous punching. These small joints, although well suited for diffusing the majority of compression forces applied to the hand during routine usage, cannot easily withstand the stress imposed by boxing and are prone to deterioration.

An isolated episode of trauma can cause a serious carpometacarpal (CMC) sprain. Repeated injury often results in progressive joint derangement with formation of a characteristically painful mass of hypertrophic bone overlying the carpometacarpal juncture, descriptively termed traumatic metacarpal bossing. In some cases chronic instability leads to obliteration of these critical joints and disabling traumatic arthritis.

The classic boxer fracture, which despite common belief is an infrequent occurrence among competitive boxers, involves the small finger metacarpal neck or metaphysis and often results from a haphazard or "sloppy" punch. Far more prevalent is fracture of the index, long, and ring finger metacarpal shaft, or diaphysis. Contingent on the multi-directional forces of injury causing angular, rotatory, and axial displacement, the configuration of these fractures may be transverse, oblique, or spiral-oblique. A direct force on the dorsal surface of the tightly clenched fist is apt to cause a transverse fracture plane resulting in dorsal angulation with a clearly visible prominence of the proximal fracture fragment. A major angular component of injury, usually due to a misdirected blow, causes the oblique or spiral-oblique fracture-often resulting in a conspicuous rotational deformity with overlapping of the injured and adjacent digits.

With all displace metacarpal fractures, a consistent deformity, and one requiring prompt correction, is excessive bony shortening. Failure to restore critical metacarpal length and the normal contour of the metacarpal head is liable to result in a serious compromise of punching mechanics and boxing skills. Indeed, seemingly minimal disturbances in metacarpal alignment—as little as 5 degrees of malrotation, 20 degrees of dorsal angulation, or 3 millimeters of shortening—can lend to considerable deformity with major dysfunction unless detected and corrected.

In addition, the prominent position and rigidity of the second and third metacarpals make them particularly susceptible to bending torques applied over the dorsal aspect of the metacarpal heads during forced palmar flexion of the wrist when the fingers are not in a position to dissipate the applied force.

The thumb, in contrast to the rigid central digits, is a highly mobile unit with inherent instability and vulnerability owing to a paucity of strong ligamentous attachments as well as the absence of protective border digits. This configuration subjects the thumb to detrimental forces in various planes. Hyperextension and angular forces are apt to disrupt the collateral ligaments of the metacarpophalangeal joint, whereas axial compression is the deleterious mechanism of fracture, dislocation, or fracture-dislocation of the carpometacarpal joint. Thus, the thumb is most vulnerable to collateral ligament rupture of the metacarpophalangeal joint and carpometacarpal fractures or fracture dislocation.

Conventional attempts to prevent these hand injuries, and reduce the incidence of further injury during rehabilitation, have utilized various methods in attempts to protect the hand during activities in which there is a potential of injury from blunt trauma to the hand. One conventional device which attempts to prevent injury to the hand is a bandage formed by wrapping muslin or a similar material and tape around portions of the hand. For example, the rules of Olympic competition permit wrapping areas of each hand with only one yard of muslin bandage. Another approach utilizes custom-fit, molded casts or structures which cover the metacarpophalangeal joints. These approaches do not protect against the forces which are transmitted to common sites of injury. Still another conventional method is the use of padding or a balloon placed over an injured knuckle to attempt to deflect force away from a damaged metacarpophalangeal joint. These approaches suffer from several disadvantages. Since they are not fabricated in accordance with rational protection against predictable forces imposed on these sites, well recognized for their vulnerability to injury, and since they are not designed to minimize excessive motion of the joint, these ill conceived bulky bandages, casts, or padded structures afford little protection to the hand because they do not provide the necessary impact attenuation. This is especially so in the case of the more compact bandage sanctioned for Olympic competition. Furthermore, conventional hand protection devices do not stabilize the joints so as to reduce the risk of carpometacarpal and metacarpophalangeal joint injury and subluxation dislocation.

SUMMARY OF THE INVENTION

One object of the present invention is to provide an apparatus for maintaining anatomical metacarpophalangeal and carpometacarpophalangeal alignment and length, while protecting the anatomical configurations of the hand subject to injury, by acting as a shock absorber to attenuate and diffuse axial compression, tension, rotational and other detrimental forces transmitted to the anatomical configurations.

It is another object of the present invention to provide an apparatus which conforms to the anatomy of the metacarpophalangeal joints (MPJ), or "knuckles," both dorsally and volarly so as to simultaneously stabilize the joints and dissipate excessive dorsal axial compression and tensile forces apt to cause votar subluxation.

It is another object of this invention to provide an apparatus which supports, cushions, and stabilizes the metacarpophalangeal joints (MPJ) both dorsally and volarly to restrict excessive flexion and prevent subluxation and minimize transmission of detrimental forces to the metacarpophalangeal Joint (MPJ), and to the carpometacarpal Joint (CMJ) of the hand.

Another object of the present invention is to provide an apparatus that can be utilized in any activity prone to excessive, injurious, blunt trauma to the hand, for example, in contact sports such as boxing, karate or football, or in performing occupational duties such as law enforcement or military service.

Still another object of the present invention is to provide an apparatus that can also be used to prevent injuries in non-contact sports prone to injuries of the hand, such as snow skiing during which the hand is often subjected to severe trauma by striking the ground or other objects such as trees or uncontrolled ski poles.

It is an additional object of the present invention to provide an apparatus that can be used in the rehabilitation phase of treatment resulting from injuries to the hand to prevent further injuries.

It is yet another object of the present invention to provide an apparatus which reduces the likelihood of injury to specific anatomical configurations such as, for example, the protrusive metacarpophalangeal joints (MPJ) of the fingers and the thumb, and the carpometacarpal joints (CMCJ) of the fingers and thumb by evenly dissipating compression, rotational and angular forces across the dorsal and volar surfaces overlaying the proximal segment of the thumb, index, long, ring, and small fingers so these forces are not concentrated on the localized area of soft tissue surrounding the carpometacarpal Joint (CMCJ) and metacarpophalangeal Joint (MPJ).

It is a further object of the present invention to provide an apparatus which stabilizes the vulnerable metacarpophalangeal joint (MPJ) and carpometacarpal joint (CMCJ) so as to minimize the likelihood of injuries such as extensor disruption, subluxation, and traumatic metacarpal bossing.

It is still a further object of the present invention to provide an apparatus which protects the wrist; namely the carpus, the radiocarpal joint (RCJ) and the distal radioulnar joint (DRUJ).

It is yet another object of the present invention to provide an apparatus for protecting the hand from injuries resulting from impact with an object, which comprises: a shell having a proximal end and a distal end, the shell provided with an outer member having a proximal end and a distal end and an inner member having a proximal end and a distal end, the inner surface of the outer member communicating with the dorsal surface of the hand, the inner surface of said inner member communicating with the volar surface of the hand; the outer member and the inner member cooperating to attenuate impact forces to the anatomical configurations of the hand and to stabilize the joints of the hand so as to reduce the likelihood of joint flexion and hyperextension of the thumb.

DETAILED DESCRIPTION OF THE DRAWINGS

Figure 1:
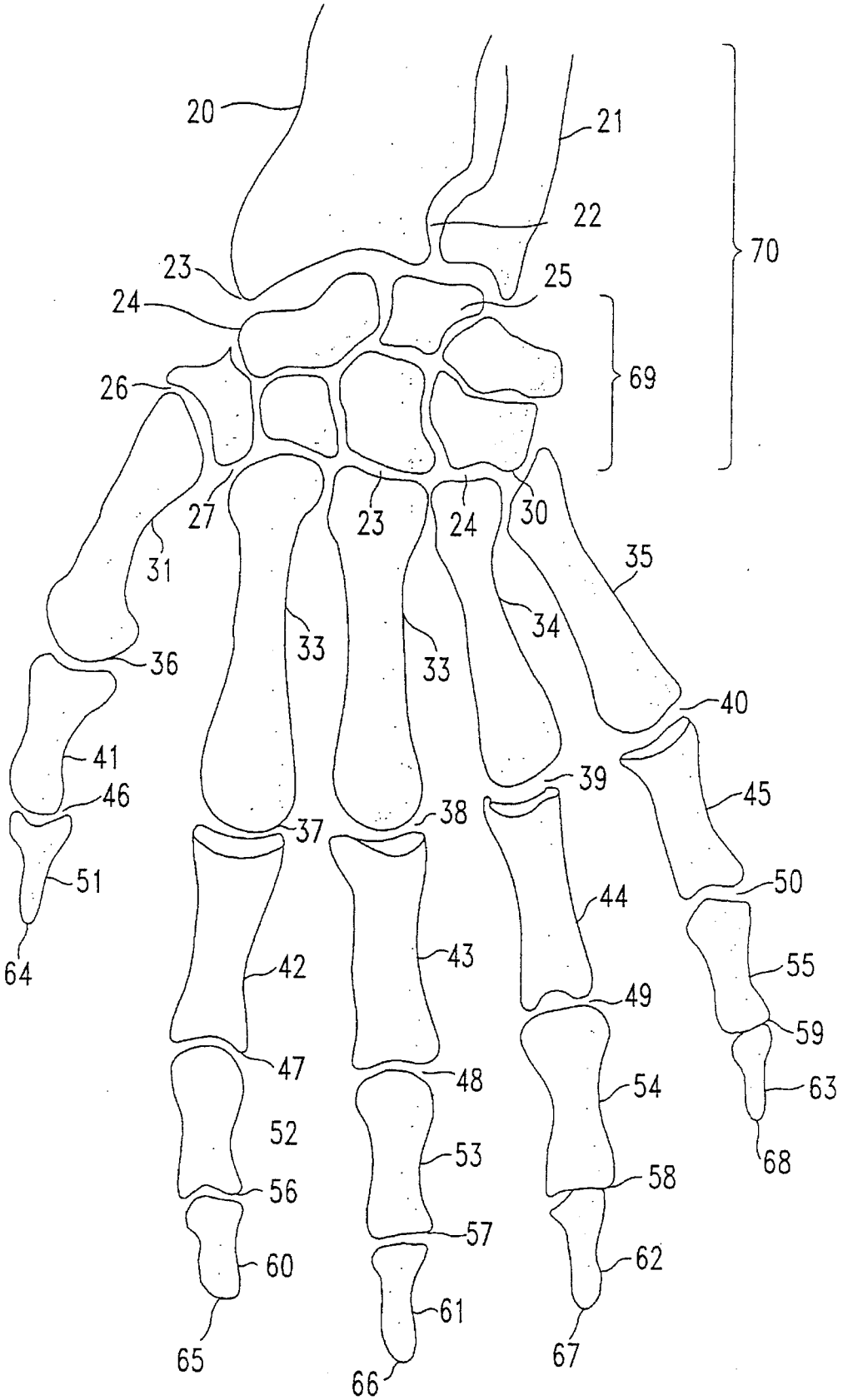
FIG. 1 shows the skeleton of the human hand.

FIG. 1 is a view of the skeleton of the human hand and shows the radius 20, ulna 21, radiocarpal joint (RCJ) 23, distal radioulnar joint (DRUJ) 22, scaphoid 24, lunate 25, carpus 69, thumb 64, index finger 65, long finger 66, ring finger 67, and small finger 68.

The thumb 64 is comprised of the distal phalanx 51, the interphalangeal joint (IPJ) 46, proximal phalanx 41, metacarpophalangeal joint (MPJ) 36, metacarpal 31, and carpometacarpal joint (CMCJ) 26.

The index finger 65 is comprised of the distal phalanx 60, distal interphalangeal joint (DIPJ) 56, middle phalanx 52, proximal interphalangeal joint (PIPJ) 47, proximal phalanx 42, metacarpophalangeal joint (MPJ) 37, metacarpal 32, and carpometacarpal joint (CMCJ) 27.

The long finger 66 is comprised of the distal phalanx 61, distal interphalangeal joint (DIPJ) 57, middle phalanx 53, proximal interphalangeal joint (PIPJ) 48, proximal phalangy 43, metacarpophalangeal joint (MPJ) 38, metacarpal 33, and carpometacarpal joint (CMCJ) 28.

The ring finger 67 is comprised of the distal phalanx 62, distal interphalangeal joint (DIPJ) 58, middle phalanx 54, proximal interphalangeal joint (PIPJ) 49, proximal phalanx 44, metacarpophalangeal joint (MPJ) 39, metacarpal 34, and carpometacarpal joint (CMCJ) 29.

The small finger 68 is comprised of the distal phalanx 63, distal interphalangeal joint (DIPJ) 59, middle phalanx 55, proximal interphalangeal joint (PIPJ) 50, proximal phalanx 45, metacarpophalangeal joint (MPJ) 40, metacarpal 35, and carpometacarpal joint (CMCJ) 30.

Figure 2:
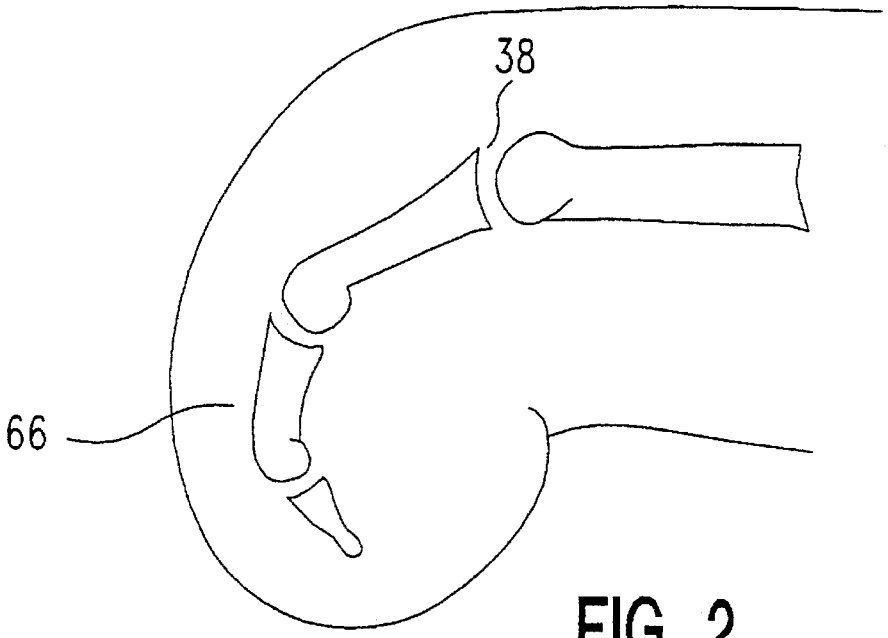
FIG. 2 is sagittal or lateral view of a clenched human fist within a boxing glove.
Figure 3:
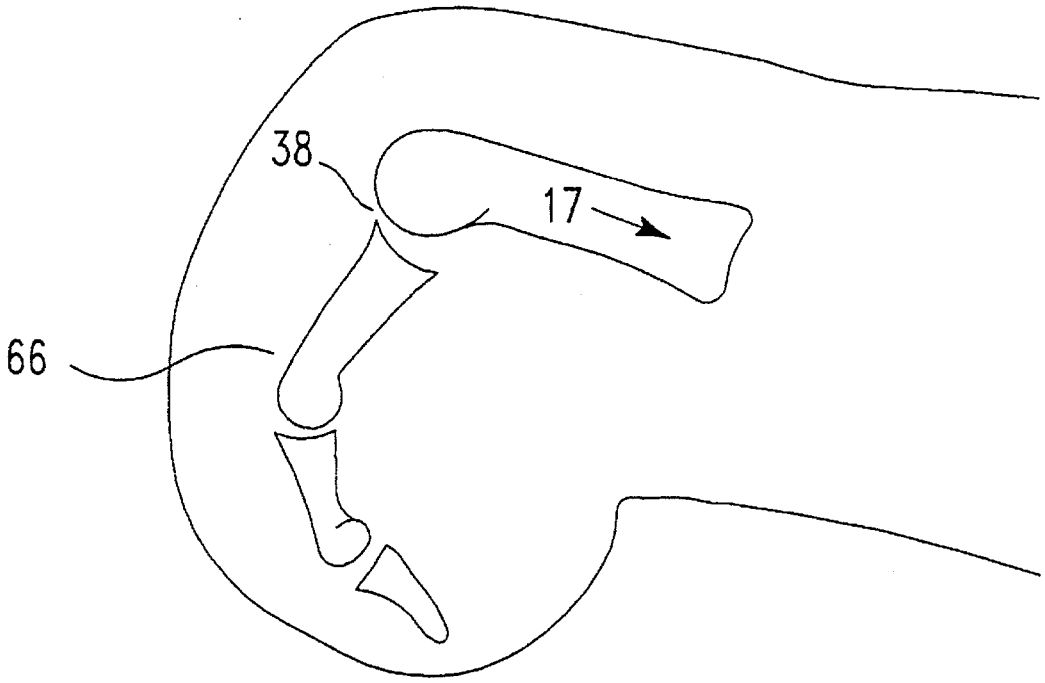
FIG. 3 is a view of the fist of FIG. 2 shown upon impact with an object.

FIG. 2 is a sagittal section through the long finger 66 of a gently clenched human fist contained within a boxing glove. The metacarpophalangeal joint (MPJ) 38 is positioned in a state of mild flexion while maintaining normal joint contours because no compression forces are applied. FIG. 3 shows the configuration of the metacarpophalangeal joint (MPJ) 38 when it is exposed to the enormous forces generated by punching an object. FIG. 3, in contrast to FIG. 2, shows that the metacarpophalangeal joint (MPJ) 38 demonstrates a position of excessive flexion, almost to a degree of subluxation. FIG. 3 also shows the axial forces 17 transmitted to the carpometacarpal joint 28 (CMCJ). Concurrently, the extensor mechanisms and joint capsules are stretched to maximum tension over the prominent metacarpal heads. Owing to this vulnerable posture at the time of impact, the soft tissue and skeletal components of the boxer's knuckles are prone to injury.

Figure 4:
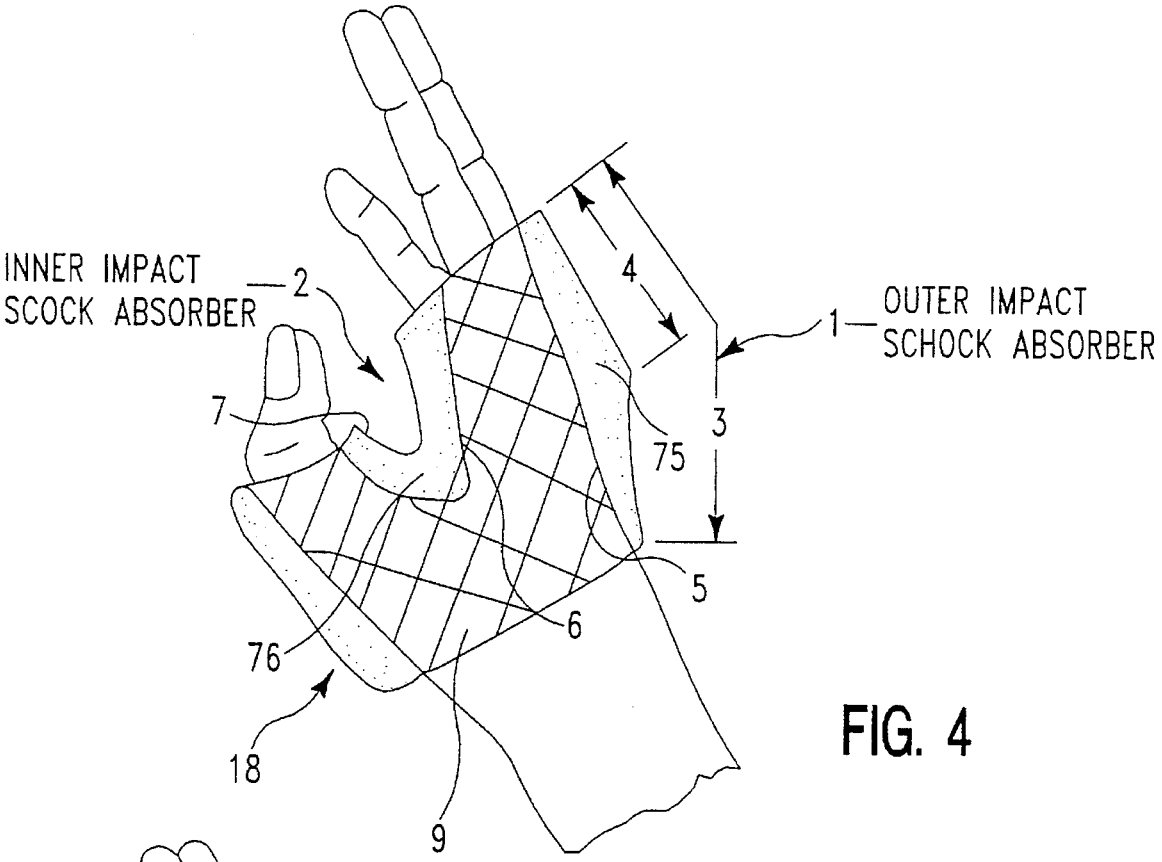
FIG. 4 is a lateral view of a representative embodiment of a hand protector and joint stabilizer constructed in accordance with the present invention.

FIG. 4 is a lateral view of a hand protector and joint stabilizer 18 constructed in accordance with the present invention and shows shell 9 provided with an outer member 1, covering the dorsal aspect of the fingers 65, 66, 67, and 68 of the hand from a location proximal to the carpometacarpal joints (CMCJ) 26, 27, 28, 29, and 30 to a point distal to the metacarpophalangeal joints (MPJ), or knuckles 36, 37, 38, 39 and 40. An inner member 2, covers the volar aspect of the hand from a location proximal to the carpometacarpal joints (CMCJ) 26, 27, 28, 29 and 30 and to a point distal to the metacarpophalangeal joints (MPJ)36, 37, 38, 39, and 40. The outer member 1 also encases the thumb 64 at an oblique angle to the thumb shaft, from a location proximal to the carpometacarpal joint (CMCJ) 26 and distal to the metacarpophalangeal joint (MPJ) 36, or knuckle so as to substantially immobilize the thumb 64 which is highly prone to injury when it is abruptly pulled away from the other fingers.

The outer member 1, covering the dorsal aspect of the hand comprises an outer surface 3 and an inner surface 5. The inner surface 5 can be adapted to conform precisely to the metacarpophalangeal joints (MPJ)of an individual. The outer member 1 and inner member 2 act as impact shock absorbers. In addition, the outer member 1 cooperates with the inner member 2 to stabilize the carpometacarpal (CMC) and metacarpophalangeal joints (MPJ).

The outer member 1 and the inner member 2 of the hand protector and joint stabilizer 18 act as impact attenuators and also cooperate to stabilize the joints. Cushioning the impact of blows to the hands and stabilizing the joints against excessive flexion protects the carpometacarpal and metacarpophalangeal joints of the hand, thereby reducing the incidence of injuries such as, for example, extensor disruption or subluxation of the metacarpophalangeal joints, traumatic metacarpal bossing, or fracture dislocation of the thumb.

A portion of the outer surface 3 can be configured to provide a hitting or contact surface 4 for impact with an object. The hitting or contact surface 4 can be configured to provide either a substantially flat or a gently contoured surface for impact with an object, however, in a preferred embodiment the hitting surface 4 is substantially flat so that substantially the entire area of the hitting surface 4 makes contact with the punched object at substantially the same time. Maximizing the area of the hitting surface 4 which makes contact with the punched object diffuses and attenuates the forces generated by the impact over a greater area and minimizes the axial compression, tension, rotational, and other detrimental forces acting on a localized area of soft tissue surrounding the anatomical configurations of the hand subject to injury, particularly to the metacarpophalangeal joints 37 and 38 of the index finger 65 and the long finger 66.

The inner member 2, which covers the volar aspect of the hand, comprises an inner surface 6 and an outer surface 7. From the inner surface 6, an amount of material 76 can be built upon varied as specific applications dictate to form a cushion or impact absorbing portion 76 between the inner surface 6 and the outer surface 7 of inner member 2. In a preferred embodiment, the inner surface 6 is adapted to conform to the inner surface of a clenched-fist and to the volar surface of the fingers and the inner surface 6 and the outer surface 7 is adapted to accommodate flexion and opening of the hand. The inner member 2 encases the metacarpophalangeal joints (MPJ)36, 37, 38, 39 and 40 and carpometacarpal joints (CMCJ) 26, 27, 28, 29, and 30 and serves as a restraint to excessive metacarpophalangeal flexion as well as a shock absorber which diffuses and attenuates excessive axial compression, tension, rotational, or other detrimental forces on the metacarpophalangeal joints (MPJ)and reduces the forces transmitted to the carpometacarpal joints (CMCJ). The inner member 2 also cooperates with the outer member 1 to stabilize the metacarpophalangeal joints (MPJ)36, 37, 38, 39, and 40 and the carpometacarpophalangeal (CMC) joints 26, 27, 28, 29, and 30.

In a preferred embodiment, the inner member 2 and outer member 1 envelope the thumb 64 in clenched fist posture from just proximal to the carpometacarpal joint (CMCJ) to a level just proximal to the thumb interphalangeal (IP) joint 46. Immobilizing the thumb 64 minimizes the likelihood that the thumb 64 will be displaced upon impact with a surface. In this way, the hand protector and joint stabilizer 18 reduces the axial, compression, tension, rotational, and other detrimental forces acting on the thumb and reduces fracture, dislocation, or fracture-dislocation as well as injuries to the scaphoid bone 24. It should be noted that when the hand protector and joint stabilizer 18 is extended to incorporate the thumb 64, the application of the device to the hand is accomplished easily since the fingers remain relatively free.

Figure 5:
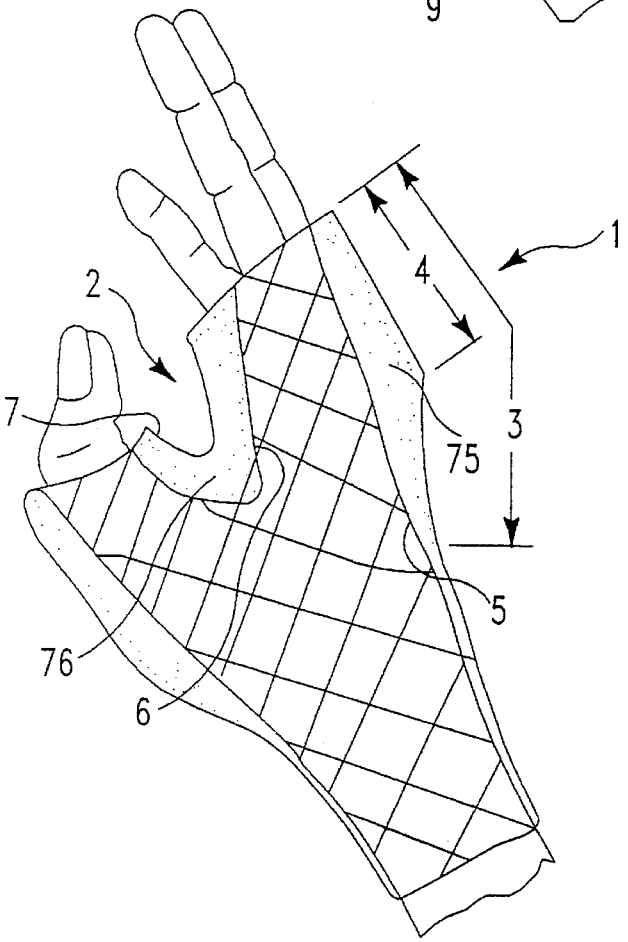
FIG. 5 is a lateral view of an alternative embodiment, incorporating the wrist, of a hand protector and joint stabilizer constructed in accordance with the present invention.

FIG. 5 is a lateral view of an alternative embodiment of the present invention in which the outer member 1 and the inner member 2 are extended to provide additional protection and stabilization to the wrist 70. This embodiment can also be reinforced in a concave fashion over the radial aspect of the wrist (as shown in FIGS. 7B and 8B) and in a convex fashion over the distal ulnar or ulnar aspect of the wrist to provide additional stability, thereby minimizing fracture of the scaphoid 24 or disruption of the distal radioulnar joint (DRUJ) 22.

Figure 6:
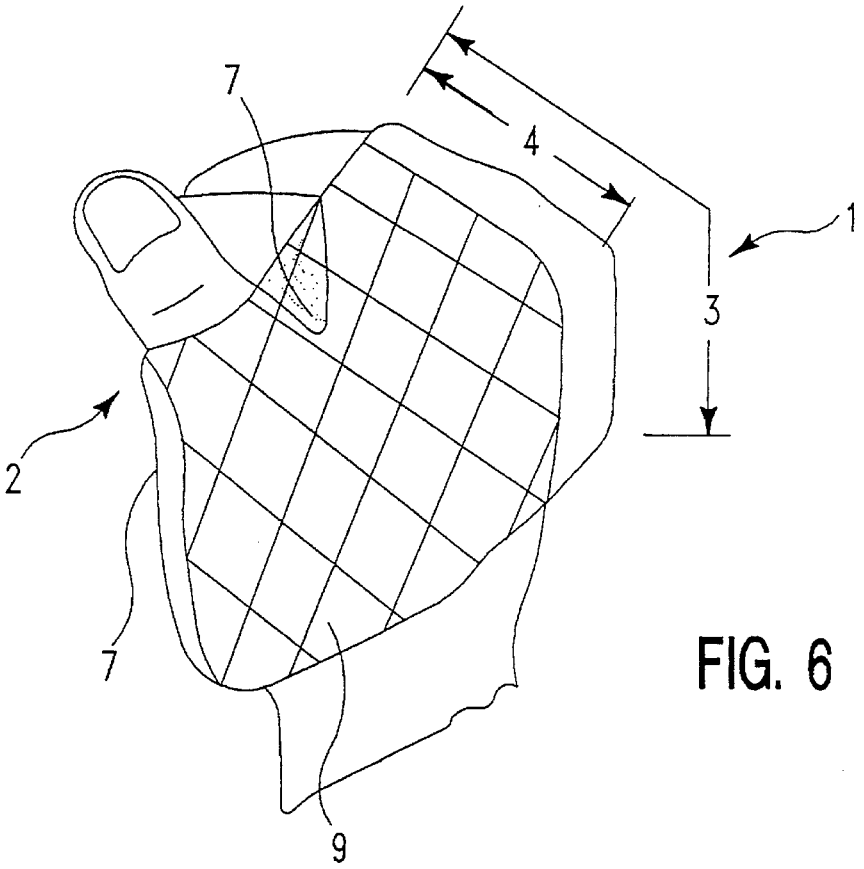
FIG. 6 is a lateral view of the hand protector and joint stabilizer of FIG. 4 covering a clenched fist.

FIG. 6 is a lateral view of the embodiment of FIG. 4 worn by a hand clenched into a fist and shows the striking surface 4 of the outer surface 3 of the outer member 1.

Figure 7:
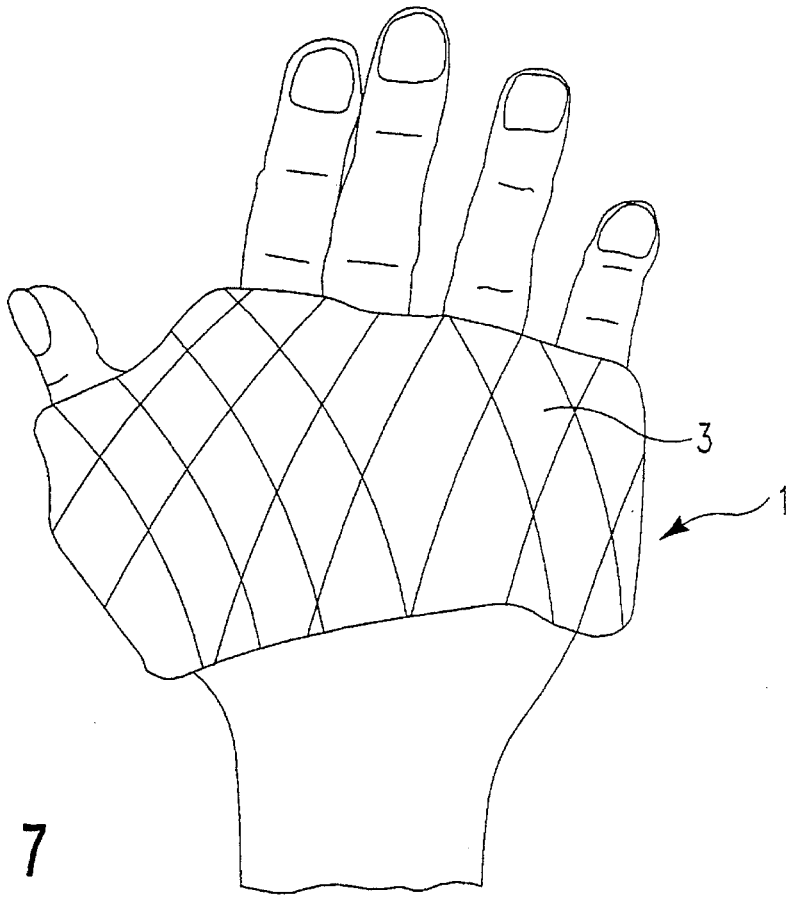
FIG. 7 is a dorsal view of the hand protector and joint stabilizer of FIG. 4 covering an open hand.
Figure 7A:
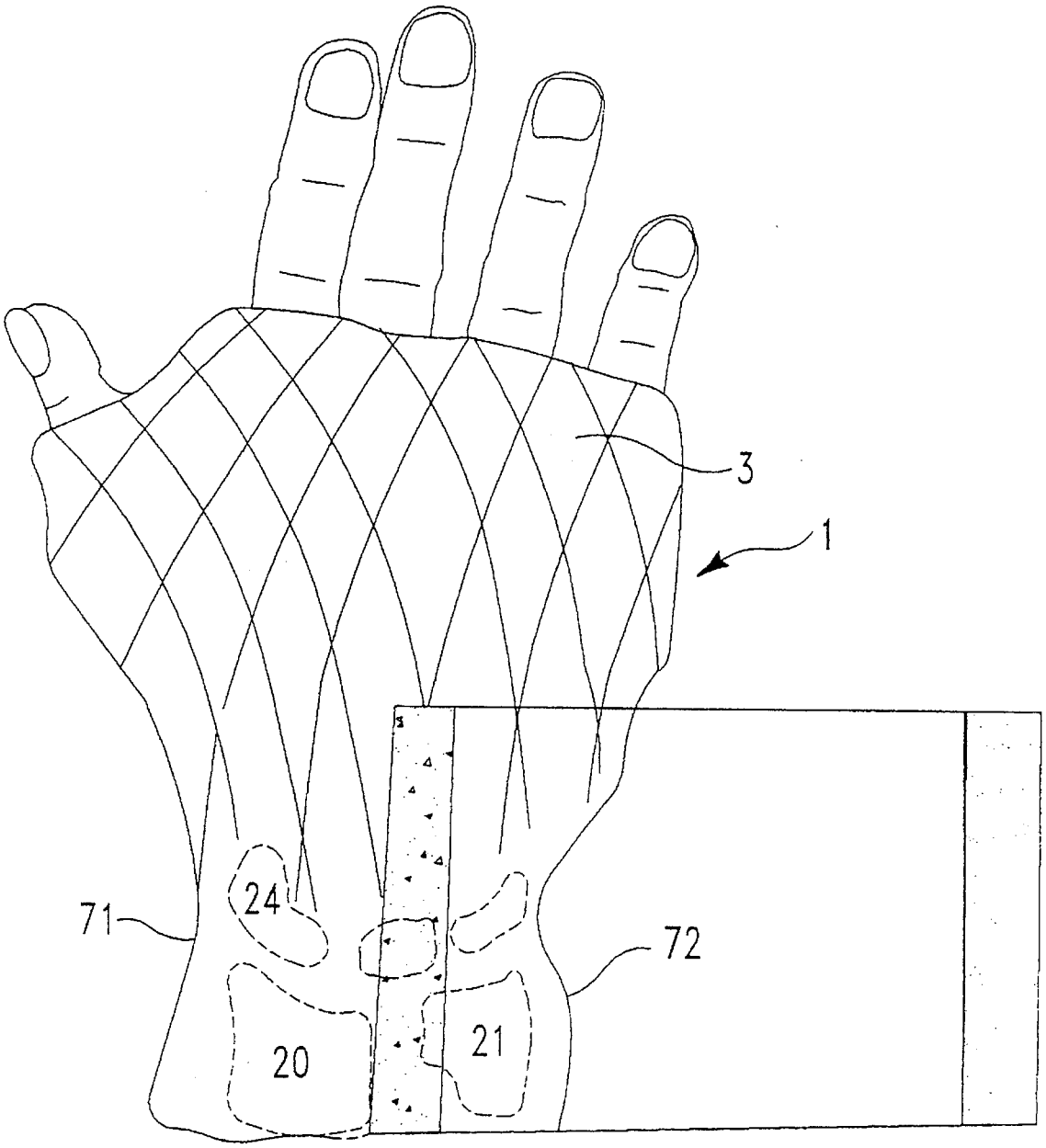
FIG. 7A is a dorsal view of the hand protector and joint stabilizer of FIG. 5 covering an open hand, extending more proximally to incorporate the wrist.

FIG. 7 is a dorsal or top view of the embodiment shown in FIG. 4 carried by an open hand and shows the outer surface 3 of the outer member 1 which extends distally just proximal to the proximal interphalangeal joint flexion creases, thereby, cushioning the metacarpophalangeal joints (MPJ). Proximally it encapsulates the base of the thumb 64 with its carpometacarpal joint (CMCJ) 26 and the finger carpometacarpal joints (CMCJ) 27, 28, 29, 30.

FIG. 7B is a dorsal or top view of the embodiment shown in FIG. 5 carried by an open hand which extends proximally to cover the entire wrist 70 and is provided with a concave contour 71 radially over the scaphoid 24 and distal radius 20 and a convex contour 72 ulnaraly over the distal radioulnar joint (DRUJ) 22 and distal ulna 21. Contours 71 and 72 impart additional stability, thereby reducing the likelihood of fracture of the scaphoid 24 or disruption of the distal radioulnar joint (DRUJ) 22.

Figure 8A:
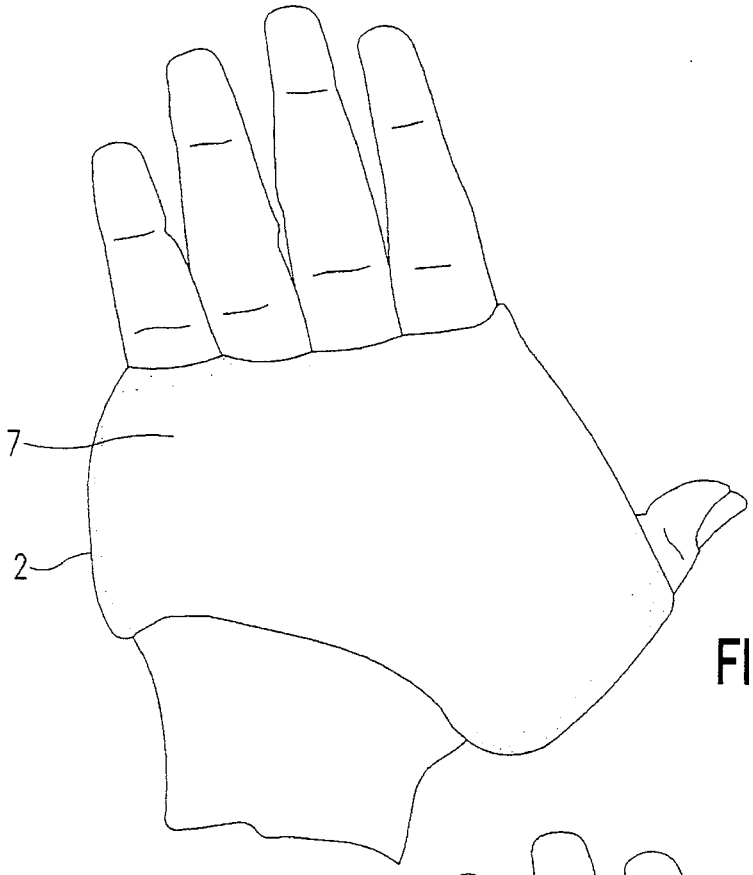
FIG. 8A is a palmar or volar view of the hand protector and joint stabilizer of FIG. 4.
Figure 8B:
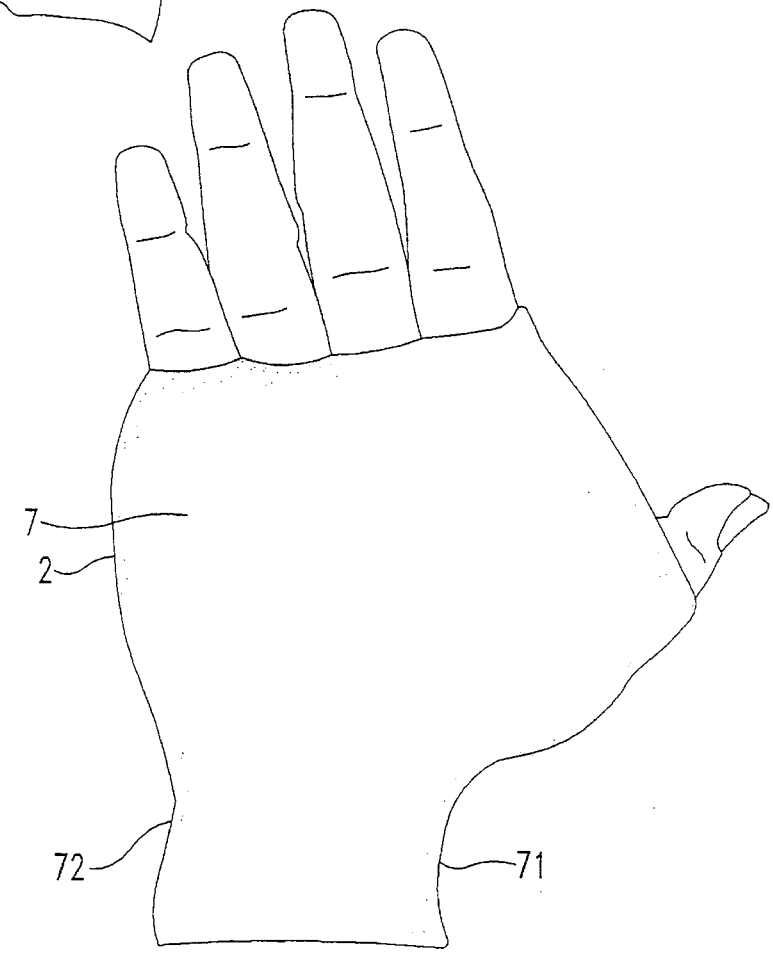
FIG. 8B is a palmar or volar view of the hand protector and joint stabilizer of FIG. 5 covering an open hand and the wrist.

FIG. 8 is a palmar or volar view of the embodiment shown in FIG. 4 carried by an open hand and shows the outer surface 7 of the inner member 2.

FIG. 8B is a palmar or volar view of the embodiment shown in FIG. 7B and shows the outer surface 7 of the inner member 2.

Figure 9:
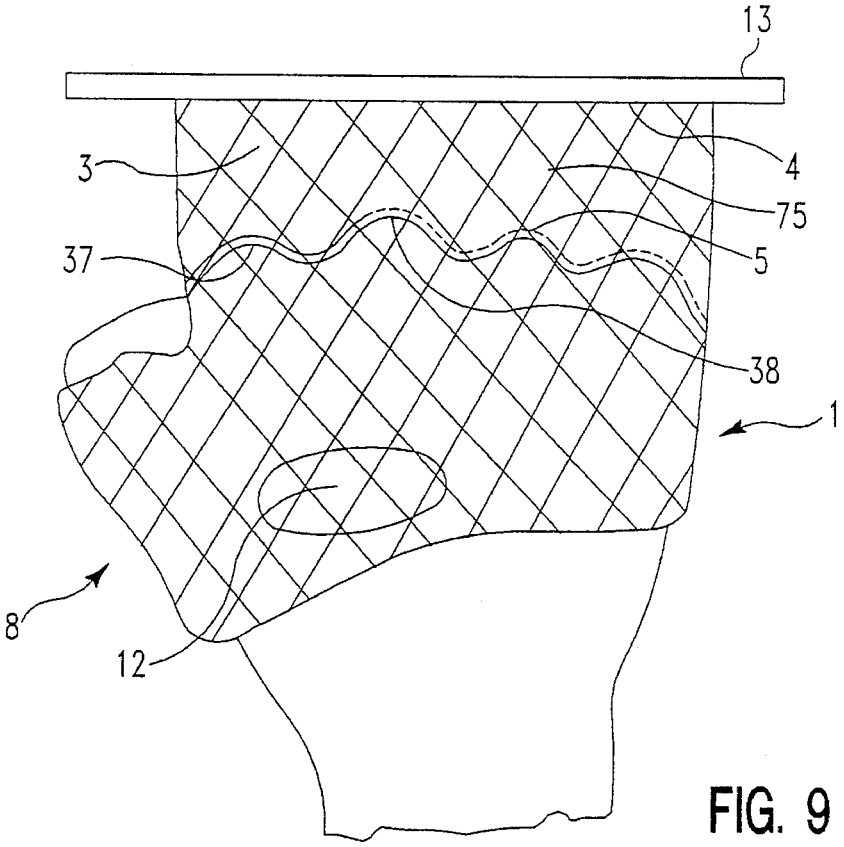
FIG. 9 is a dorsal view of the hand protector and joint stabilizer of FIG. 4 covering a clenched fist and depicting contact with an object.

FIG. 9 is a dorsal view of the embodiment shown in FIG. 4 depicting a clenched fist punching an object 13 and shows the outer surface 3 of outer member 1, the hitting surface 4, the inner surface 5, an area 12 on the hand overlying the carpometacarpal joints (CMCJ) 27 and 28 and the metacarpophalangeal joints (MPJ) 37 and 38 corresponding to the index finger 65 and long finger 66. The inner surface 5, can be adapted to conform precisely to the carpometacarpal joints (CMCJ) of the user and may be provided with protrusions corresponding to protrusions inherent in the anatomical configurations of the hand, i.e., the metacarpophalangeal joints (MPJ) 36, 37, 38, 39, 40 corresponding to the thumb 64, the index finger 65, the long finger 66, the ring finger 67, and the small finger 68. From the inner surface 5, an amount of material can be built up and varied as specific applications dictate to form a cushion or impact absorbing portion 75 between the inner surface 5 and the outer surface 3 of outer member 1. In addition, the thickness of cushion or impact absorbing portion 75 allows for the reduction of the protrusions of the metacarpophalangeal joints (MPJ) 37, 38, 39, and 40 in order to provide the substantially flat or gently contoured striking surface 4 of the outer surface 3.

The outer surface 3 allows for contact with the struck object 13 to occur along substantially the entire area of the substantially flat or gently contoured striking portion 4. The striking portion 4, in combination with the cushion or impact absorbing portion 6, attenuates and diffuses the primary and secondary axial compression, rotational, and tension forces and causes them to be applied uniformly to the protrusions inherent in the anatomical configurations of the hand, thus, minimizing the concentration of these forces at any given point.

In addition, the cushion or impact absorbing surface of outer surface 3 protects the anatomical configurations of the hand against primary and secondary tensions and forces which can result from contact with the object 13.

Consequently, the outer member 1 in cooperation with the inner member 2 protects the anatomical configurations of the hand, including the especially vulnerable metacarpophalangeal joints (MPJ) 37 and 38 corresponding to the index finger 65 and to the long finger 66 from extensor disruption or subluxation. The point 12 on the hand overlying the carpometacarpal joints 27 and 28 corresponding to the index finger 65 and long finger 66 is also protected from traumatic metacarpal bossing.

For specific applications, the cushion or impact absorbing portion 6 can be modified. It may be additionally padded or thickened at anatomically weakened areas, for example, for an individual user's specific needs or for various stages of rehabilitation, thus, providing additional user specific protection. The thickness of the materials employed is variable and dependent upon the intended protection and the type of material utilized. In a preferred embodiment, the materials utilized are as thin as possible while still imparting the degree of protection required.

Figure 10:
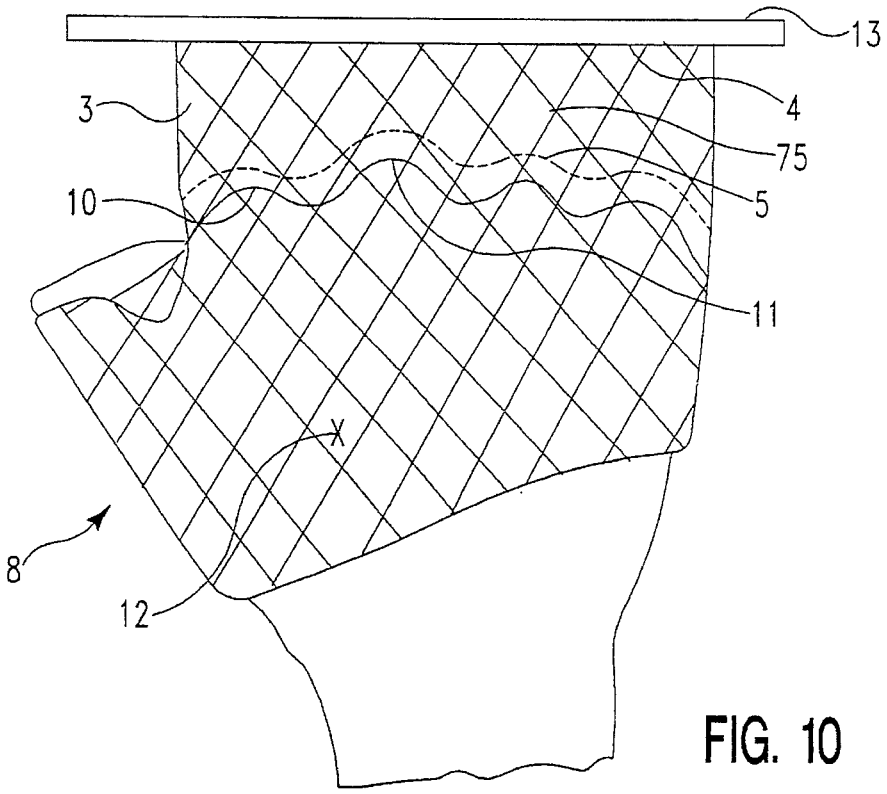
FIG. 10 is a dorsal view of an alternative embodiment constructed in accordance with the present invention covering a clenched fist and depicting contact with an object.

FIG. 10 is a dorsal view of an alternative embodiment constructed in accordance with the present invention. In this embodiment, the inner surface 5 is not precisely contoured to the anatomical configurations of an individual's hand. Instead of a custom fit, the hand protector and joint stabilizer are formed to create a "generic" fit or general contour between the inner surface 5 and the metacarpophalangeal joints (MPJ), e.g., small, medium, large, and extra-large. The inner surface 5 may be substantially flat or gently contoured and may be provided with protrusions and indentations generally corresponding to the average anatomical configurations of the hand. In this embodiment, the inner surface 5 and the cushion or impact absorbing portion 6 are comprised of a material which is sufficiently resilient to conform to the contours of the hand but which is sufficiently rigid to impart stability to the joints sufficient to minimize the possibility of excessive joint flexion. Thus, when an object is struck, the inner surface 5 and the cushion or impact absorbing portion 6 substantially conform to the anatomical configurations of the hand and diffuse the impact and stabilize the joints as previously discussed. The hand protector and joint stabilizer 18 then functions as if the inner surface 5 and cushion or impact absorbing portion 6 were formed to substantially match the anatomical configurations of the user's hand. Because this embodiment of the hand protector and joint stabilizer need not be custom made for each user, the device can be more economically manufactured and is more readily available to consumers who might not wish to incur the delay, inconvenience, and expense involved in purchasing a custom fit device.

The apparatus may also be modified to protect the dorsal, volar, ulnar, and radial aspects of the wrist as dictated by specific applications.

While the representative embodiment according to the present invention described herein is directed to protecting a hand from injuries resulting from contact sports and occupations, for example, boxing and law enforcement, the principles of the present invention are also applicable to protecting the hand from injuries resulting from other activities causing indirect or direct impact with the hands.

The apparatus can be constructed using any durable shock absorbing material, well known to those skilled in the art as suitable for this purpose, however, in a preferred embodiment viscoelastic plastic is utilized. The apparatus may also be constructed of a laminate of suitable shock absorbing material and muslin bandage. The material should be able to attenuate the impact of a blow while still being able to impart sufficient rigidity to the joints so as to stabilize the joints and reduce the risk of subluxation. In an alternative embodiment, the shock absorbing material can be overlaid with a plurality of muslin or gauze layers, or materials constructed in non-layer form. The materials used in constructing the hand protector and joint stabilizer are not limited to that of the representative embodiment. The materials can consist of any material or combination of materials suitable for achieving the concepts underlying the invention. The materials may be known to a person skilled in the fields of art applicable to the present invention or analogous fields of art. However, the present invention is not dependent on any one material for its construction. Therefore, materials which become known to a person skilled in the fields of art applicable to the present invention or analogous fields of art would be within the scope of the invention.

What is claimed is:

1. Apparatus for protecting the hand from injuries comprising:

a) a shell surrounding the hand from approximately the carpometacarpal joints to beyond the knuckles;

b) an outer impact shock absorbing member attached to said shell on an outside surface thereof and covering the back of the hand to beyond the knuckles;

c) said outer shock absorbing member having an outer flat surface an inner surface molded with protrusions and indentations corresponding to the configuration of the knuckles;

d) an inner impact shock absorbing member attached to said shell on an outside surface thereof and covering the palm of the hand beyond the knuckles; and e) said inner member having an outer surface configured to restrain excessive knuckle flexion and cooperating with said outer member to stabilize the knuckles and the carpometacarpal joints.

2. Apparatus of claim 1 wherein said inner and outer shock absorbing members envelop the thumb.

3. Apparatus of claim 1 wherein said shell and said inner and outer members are extended to incorporate the wrist.

4. Apparatus of claim 3 wherein said shell and said inner member conform to the front of the wrist.

5. Apparatus of claim 3 wherein said shell and said outer member conform to the back of the wrist.

6. Apparatus of claim 1 wherein the outer surface of said outer impact shock absorbing member has a substantially flat contact surface for impact with an object.

* * * * *

UNITED STATES PATENT AND TRADEMARK OFFICE

CERTIFICATE OF CORRECTION

PATENT NO. : 5,572,738

DATED : November 12, 1996

INVENTOR(S) : Melone, Jr.

It is certified that error appears in the above-indentified patent and that said Letters Patent is hereby corrected as shown below:

Title page item [73], is missing: It should read as follows:

--Assignee: Manus Sports Gloves

New York, New York--;

The Cover Sheet (the figure) "SCOCK" should be --SHOCK-- and "SCHOCK" should be --SHOCK--;

Fig. 4, "SCOCK" should be --SHOCK-- and "SCHOCK" should be --SHOCK--.

Signed and Sealed this

Third Day of March, 1998

*Attest:*

*Attesting Officer*

Bruce Lehman

BRUCE LEHMAN

*Commissioner of Patents and Trademarks*